United States Patent [19]

Sammaritano

[11] 3,998,348

[45] Dec. 21, 1976

[54] NURSING BOTTLE

[76] Inventor: Michael Sammaritano, 120 E. Hartsdale Ave., Hartsdale, N.Y. 10530

[22] Filed: Aug. 15, 1975

[21] Appl. No.: 605,112

[52] U.S. Cl. ..... 215/11 E; 222/100

[51] Int. Cl.[2] ..... A61J 9/00

[58] Field of Search ..... 222/92, 99, 100; 215/11 E

[56] References Cited

UNITED STATES PATENTS

| | | | |
|---|---|---|---|
| 3,143,429 | 8/1964 | Swanson | 215/11 R |
| 3,204,824 | 9/1965 | McGraw | 222/100 |
| 3,243,069 | 3/1966 | Ducrme | 215/11 R |
| 3,647,117 | 3/1972 | Hargest | 222/100 |
| 3,648,873 | 3/1972 | Grobbel | 215/11 R |

*Primary Examiner*—Ro E. Hart
*Attorney, Agent, or Firm*—Frank J. Jordan

[57] ABSTRACT

A nursing bottle assembly includes a bottle having a closed end and an open end with a nipple being disposed over the open end. A flexible bag within the bottle has an open end secured to the open end of the bottle. The flexible bag which has its lower end disposed within the bottle is adapted to receive the liquid to be dispensed. Biasing means are provided to create a biasing force on the flexible bag to maintain a positive pressure on the liquid in the flexible bag as the liquid is dispensed through the nipple.

11 Claims, 8 Drawing Figures

NURSING BOTTLE

BACKGROUND OF THE INVENTION

This invention relates to a nursing bottle and more particularly to a nursing bottle used for feeding fluids such as milk or the like to infants and babies.

Heretofore, known nursing bottles have had the disadvantage that use of the bottle would cause air to be introduced into the baby's mouth and stomach, thereby resulting in colic and making the baby uncomfortable. Attempts to alleviate this condition have not heretofore been successful.

Accordingly, an object of the present invention is to overcome the disadvantages of known prior art arrangements and to provide a nursing bottle which is operable to prevent air from passing into the baby's mouth and stomach.

Another object of the invention is to provide a nursing bottle in which air is excluded from the bottle regardless of the quantity of liquid in the bottle.

Another object of the invention is to provide a nursing bottle which can be utilized without requiring a straw and which can be satisfactorily utilized regardless of the position or disposition of the bottle.

A further object is to provide a bottle from which air is excluded, thereby avoiding bubbles within the liquid contents.

A further object is to provide for collapsing of a flexible bag during use of the bottle so that all void spaces are continually taken up.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A nursing bottle assembly includes a bottle having a closed end and an open end with a nipple being disposed over the open end of the bottle. A flexible bag is disposed with the bottle and has an open end secured to the open end of the bottle. The flexible bag which has a lower end disposed within the bottle, is adapted to receive the liquid contents for the baby bottle. Biasing means are provided to create a biasing force on the flexible bag to maintain a positive pressure on the liquid in the flexible bag as the liquid is dispensed through the nipple.

DETAILED DESCRIPTION OF THE PREFERRED EMBODIMENTS

Figure 1:
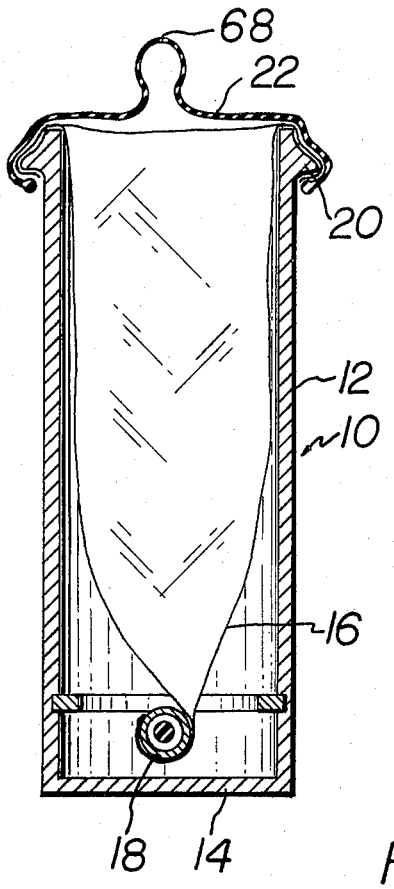
FIG. 1 is a vertical sectional view of a nursing bottle according to one embodiment of the present invention.

Referring to the drawings, FIG. 1 shows a nursing bottle 10 having cylindrical sidewall 12 and a bottom 14. Disposed within the nursing bottle is a flexible bag 16 made of plastic film material or the like and which is closed at one end. The flexible bag is adapted to be rolled on a displaceable roller assembly 18 as will be described in greater detail hereinafter. The upper end of the flexible bag 16 is open and is adapted to be draped over the open end of the bottle over an outer circumferential projection 20 circumscribing the outside of the upper portion of the bottle. Accordingly, a nipple 22 made of flexible material such as rubber or the like is fitted over the upper open end of the bottle with its outer circumferential portion disposed over the end portion of the flexible bag 16 and also over the circumscribed projection 20 such that the resilient grip of the nipple 22 holds securely the end of the bag 16 on the upper end of the bottle.

Turning now to more detailed constructional features, the longitudinal sidewalls 12 of the bottle are provided with two elongated channels 24 and 26 which may be formed in inwardly extending or enlarged longitudinally extending portions 28 and 30 respectively on the inner wall of the bottle. The channels 24, 26 extend from the bottom of the bottle to the upper terminating end thereof.

Figure 5:
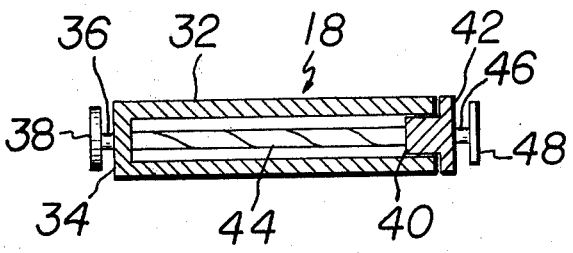
FIG. 5 is a partial sectional view of the roller on which the flexible bag is rolled.
Figure 6:
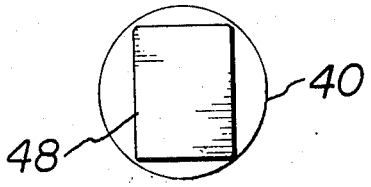
FIG. 6 is a right hand view of FIG. 5.

The channels serve as guides for the roller assembly 18. The constructional details of the roller assembly are shown in FIG. 5. Thus the roller assembly 18 comprises a roller or cylinder 32 having a longitudinal end wall 34 integrally formed or suitably joined to the cylinder 32. Secured to the circular end wall 34 is a shaft 36 to which a circular flange or guide 38 is joined. The circular flange or guide 38 is adapted to be accommodated within the channel 24 in the sidewall of the bottle as will be described hereinafter in greater detail.

The other end of the cylinder 32 is open, and suitably disposed within the open end is a plug 40 having a flanged portion 42 disposed on the longitudinal end of the cylinder 32. The plug 40 is rotatably mounted within the end of the cylinder 32. A suitable spring or resilient member 44, such as an elongated rubber element or the like, is secured to the plug member 40 and to the circular end wall 34 of the cylinder 32. Secured to the outside end of the plug member 40 by a shaft 46 is a guide member 48 which is adapted to be accommodated in the channel 26 in the sidewall of the bottle. The guide member 48 has a width just slightly less than the width of the channel 26 so that the guide member slides in the channel but cannot rotate therein.

From the above description, it will be seen that the construction of the roller assembly 18 shown in FIG. 5 somewhat resembles a common window shade in that the plug member 40 may be rotated relative to the cylindrical member 32 so as to thereby wind the spring member 44 and thereby create a rotational biasing force on the roller assembly 18.

Figure 2:
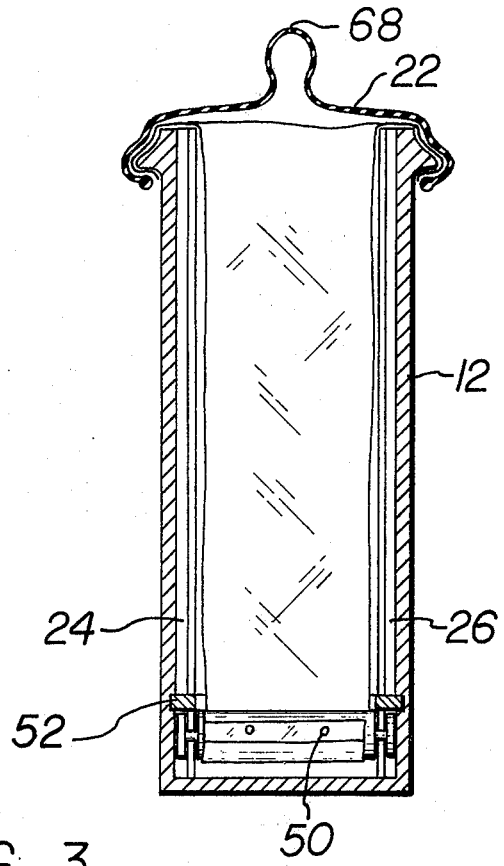
FIG. 2 is another vertical sectional view taken at ninety degrees from the sectional view shown in FIG. 1.

The roller assembly 18 may be placed in the upper, open end of the bottle with the guides 38, 48 suitably fitted into the channels 24 and 26 respectively and slid to the bottom of the bottle to the position shown in FIG. 2.

The roller assembly 18 may be provided with two projections 50 on which suitable spaced openings on a closed end portion of the flexible bag 16 are fitted so that the flexible bag 16, when completely empty, may be flattened out and manually rolled up on the roller assembly 18 before the latter is inserted into the bottle. Thus with the flattened, flexible bag 16 rolled around the roller assembly 18, the assembly is inserted into the bottle in the channels 24, 26 as previously described.

In order to hold the roller assembly 18 initially in its bottom position shown in FIG. 2, a release ring 52 is provided in the bottom of the bottle. The ring may be split as at 53. The release ring 52 is rotatable about an axis common with the longitudinal axis of the bottle and is accommodated within a circular groove 54 within the inner sidewall of the bottle. Suitable openings 56, 58 in the sidewalls of the bottle are provided so that radial projections may be manually manipulated outside of the bottle to rotate the release ring 52 as will be described in greater detail hereinafter.

Figure 4:
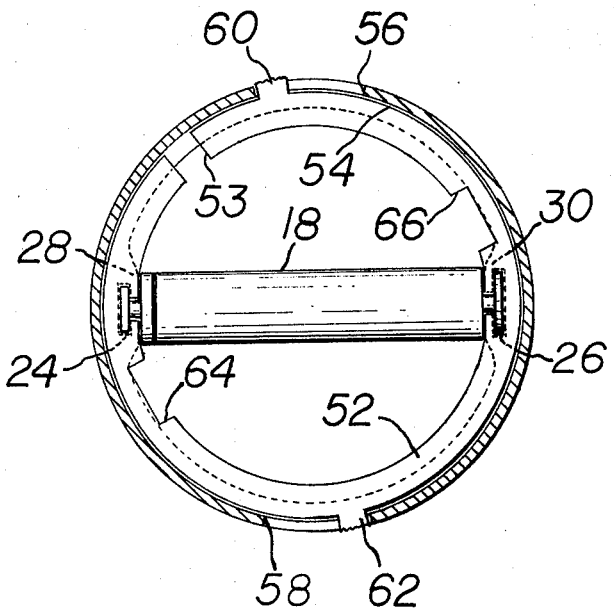
FIG. 4 is a transverse sectional view, on a larger scale, of the nursing bottle shown in FIGS. 1 to 3.

The release ring 52 has a pair of grooves 64, 66, the widths of which are just slightly greater than the width of the guides 38, 48 on the roller assembly 18. Initially the release ring 52 is rotated to a position so that the grooves 64, 66 are aligned with the channels 24, 26 respectively in the inner sidewalls of the bottle. Accordingly, in this position, the roller assembly 18 may be slid downwardly within the channels 24, 26 through the grooves 64, 66 in the release ring 52 to a position underlying the release ring 52 as shown in FIG. 2. Once this is done, the release ring 52 may be partially rotated by manually turning either of the projections 60 or 62 from the outside of the bottle to rotate the release ring 52 to a position as shown in FIG. 4 wherein the grooves 64, 66 in the release ring 52 are no longer aligned with the channels 24 and 26. In this latter position, the roller assembly 18 is held in position in the bottom of the bottle and cannot be raised due to the fact that the release ring 52 holds the guides 38, 48 in position.

With the roller assembly 18 disposed at the bottom of the bottle and the release ring 52 in the hold position as described hereinabove, the open end of the flexible bag 16 is pulled upwardly to the extent that it is draped over the upper open end of the bottle and passed around the circumscribing projection 20 wherein it is secured in such position by the biasing force of the resilient nipple 22. In order to facilitate pulling up the open end of the flexible bag 16 upwardly from its rolled up position on the roller assembly 18 to its extended position as shown in FIGS. 1 and 2, a suitable elongated tool may be provided. For example, the end of the flexible bag may be provided with two holes or more such that a tool having two prongs may be reached down into the bottle to engage the holes to facilitate pulling up the flexible bag 16. Alternatively, a pliers-type tool may be used to grasp the end of the bag 16 and pull it up for draping over the open end of the bottle.

As may be desired, the open end of the flexible bag 16 may be provided with a perforated end portion. Thus this perforated end portion would not be wound around the roller assembly 18 but rather would extend from the wound roller assembly 18 so that this perforated end portion may be grasped by a person's hand or a tool or the like to facilitate pulling the bag 16 to its position as shown in FIG. 1. Thus after the flexible bag 16 is draped over the open longitudinal end of the bottle, the end of the bag may be torn at the perforations thereby leaving the bag secured to the end of the bottle by the nipple 22 as shown in FIGS. 1 and 2. Thus the longitudinal end portion of the flexible bag beyond the perforation serves to facilitate grasping and drawing the bag to its operable position as shown in FIGS. 1 and 2.

It will be seen that as the bag 16 is pulled upwardly, since the lower end is secured to the cylindrical member 32, the latter will be rotated thereby rotating the spring 44 and creating a rotational biasing force on the roller assembly 18 similar to a common window shade. When the bag 16 is pulled to the extent shown in FIGS. 1 and 2, a biasing force is placed on the roller assembly 18 whereby the latter tends to roll upwardly in the channels 24, 26 in the side wall of the bottle. Accordingly, when the flexible bag 16 is filled with a liquid such as milk, juice or the like, and the release ring 52 is turned to the release position so that the grooves 64, 66 therein are aligned with the channels 24, 26 respectively, the biased roller assembly 18 will tend to rise up in the channels 24, 26. Accordingly, the biased roller assembly 18 will create a slight pressure on the liquid in the flexible bag but the presence of the liquid will prevent the roller from moving all the way to the top of the bottle.

The pressure created by the biased roller assembly 18 is not sufficient to force the liquid out of the opening 68 in the nipple of the bottle. However, when the baby draws in on the nipple, the liquid will flow through the nipple opening due to the suction created by the baby's mouth and the assist of the pressure created by the biased roller assembly 18. Once the nipple is taken out of the baby's mouth, the opening in the nipple will close sufficiently so that there will be no leakage through the nipple opening even though there is a slight pressure on the flexible bag 16.

As the liquid is dispensed, the roller assembly 18 will continuously move up in the bottle to take up the void space so that there is a continuous slight pressure on the flexible bag at all times, regardless of the amount of liquid in the flexible bag.

Figure 3:
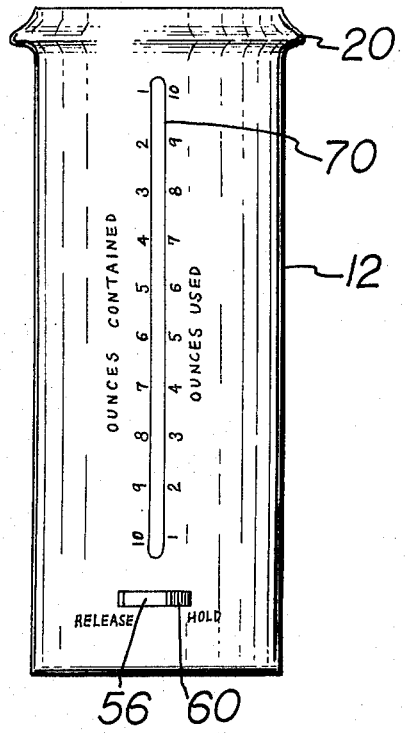
FIG. 3 is an elevational view of the nursing bottle shown in FIGS. 1 and 2.

FIG. 3 shows the projection 60 of the release ring. The projection 60 may be moved to a "Release" or a "Hold" position as mentioned above. As may be desired, a longitudinal slot 70 may be provided in the sidewall 12 of the bottle to provide for viewing the contents of the flexible bag and suitable numerical indications may be provided on the side of the bottle to indicate the amount of the liquid in the bag which has been used or which remains.

From the above description, it will be seen that there has been set forth a nursing bottle which provides a slight positive pressure on a flexible bag within the bottle, thereby making it possible for a baby to drink from the bottle in any position of the latter, that is, upright, inverted, sideways or any way inasmuch as the positive pressure prevents any air from entering the flexible bag. As the liquid is dispensed through the nipple, the roller assembly rolls upwardly along the channels to maintain pressure on the bag, thereby avoiding any air pockets or spaces in the flexible bag. Accordingly, since there will be no air in the flexible bag during the entire dispensing operation, the contents of the flexible bag is less apt to be contaminated, deteriorate, become sour, or otherwise be impaired due to extensive contact with the air. In addition, since there is no air in the flexible bag, the milk or other product does not mix with the air and there is less tendency for bubbles.

With the above construction, the baby can nurse from the bottle without a straw at any position of the bottle. Even as the baby drinks the liquid in the flexible bottle, the latter rolls up so that there is no air in the bottle and there is no vacuum created therein. In addition, the flexible bag is always full.

Figure 7:
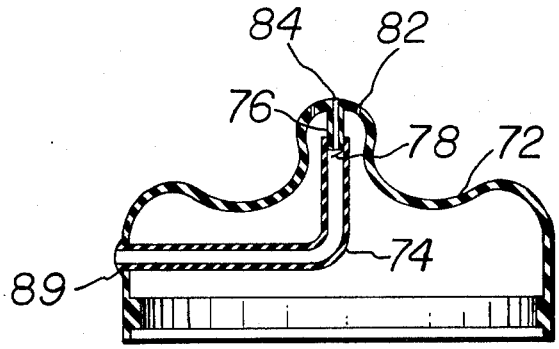
FIG. 7 is a sectional view of an alternate arrangement of a nipple for use with a nursing bottle.
Figure 8:
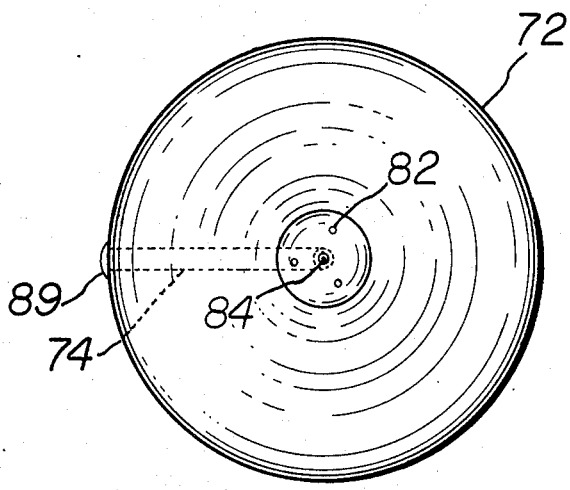
FIG. 8 is a plan view of FIG. 7.

Turning to the alternate arrangement shown in FIGS. 7 and 8, there is shown a flexible nipple 72 made of rubber or the like having an air release channel 74. There is provided in the nipple 72 a downwardly descending integral passage 76 in the center part thereof. The passage 76 has a suitable one-way flap valve 78 on the longitudinal bottom end thereof. This flap valve 78 may be integrally formed and hinged on the end of the passage 76, the flap valve 78 providing one way flow therethrough.

Disposed on the end portion of the passage 76 is the air release channel 74 which extends downwardly and then turns 90° to the side where it passes through a suitable opening in the sidewall of the nipple. A suitable end ridge 89 may be provided on the end of the air release channel and the air release channel 74 may be removed for cleaning and the like and then re-installed in the position shown in FIG. 7. Liquid intake holes 82 are provided around the opening 84 to passage 76 at suitably spaced locations. For example in the illustrated embodiment, three such liquid holes 82 are shown.

From the above arrangement, it will be seen that a baby may draw in through the liquid intake holes 82 to draw out the contents of the baby bottle as the valve 78 is closed. However, when the baby finishes sucking or drawing in and produces a positive pressure which would heretofore tend to expel or cause air or the contents of the baby's mouth to pass into the nipple, such contents or products will pass through the flap valve 78 and out through the side of the bottle through the air release passage 74. The above arrangement prevents air from entering the bottle and also prevents a baby from expelling the contents of the mouth into the nipple inasmuch as the latter will pass out through the air release passage 74.

The three holes 82 are smaller than the single nipple hole conventionally provided. These three smaller holes 82, accordingly, will close when the baby creates a positive pressure or when the baby discards the bottle.

With the above arrangement, it will be seen that air or other constituents are prevented from entering into the bottle, thereby leaving the bottle free of air and other undesirable contents.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A nursing bottle assembly comprising a bottle having a closed end and an open end, a nipple disposed over the open end of said bottle, a flexible bag disposed within said bottle, said flexible bag having an open end secured to the open end of the bottle, said flexible bag having a lower end disposed within the bottle and being adapted to receive liquid, biasing means creating a biasing force on said flexible bag tending to maintain a positive pressure on the liquid in said flexible bag as such liquid is dispensed through said nipple, said biasing means comprising a roller assembly, said lower end of said flexible bag being secured to said roller assembly, and means on said bottle for guiding said roller assembly for longitudinal displacement as the liquid in said flexible bag is dispensed.

2. A nursing bottle according to claim 1 wherein said roller assembly includes a cylinder on which the end of said flexible bag is secured, a plug means rotatably mounted on said roller assembly, and spring means extending between said plug means and said cylinder so that a rotational biasing force is adopted to be created between said cylinder and said plug means.

3. A nursing bottle according to claim 1 wherein said bottle is provided with two longitudinal channels, said roller assembly having guide members at the longitudinal ends thereof accommodated with said channels such that said roller assembly is adapted to be displaced along the length of said bottle as said guide members are guided in said channels.

4. A nursing bottle according to claim 3 wherein one of said guide members is received in one of said channels to preclude rotation of said guide member as the latter is displaced along said channel.

5. A nursing bottle according to claim 3 wherein said biasing means further comprises a release ring, a circumferential channel within the inner wall of said bottle for rotatably receiving said ring, said ring having a pair of opposed grooves, said ring having at least two rotational positions wherein in one position, said grooves are aligned with said channels in said bottle and in a second position, said grooves are displaced from alignment with said channels, said release ring being disposed at a position such that said roller assembly guide members may be disposed in the lower portion of said bottle and said release ring is turned to said second position to prevent said roller assembly guide members from passing upwardly in said channels in the bottle.

6. A nursing bottle according to claim 5 further comprising at least one opening in the sidewall of said bottle, said release ring having at least one projection passing through said opening in said bottle, whereby said projection is adapted to be grasped by a person's hand to manually rotate said ring from outside of said bottle.

7. A nursing bottle according to claim 1 wherein said flexible bag has a closed end which is secured to said roller assembly and wherein said open end of said bag is draped around the open longitudinal end of said bottle, said nipple also being disposed over the open end of said bottle and securing said open end of said flexible bag over the open end of said bottle.

8. A nursing bottle according to claim 1 wherein said flexible bag has an extending portion secured to the open end of the flexible bag by perforations, said extending portion being adapted to facilitate assembly of said flexible bag within said bottle and being adapted to being separated from the main portion of the bag after assembly.

9. A nursing bottle according to claim 1 wherein said nipple comprises a central opening and an air release passage extending from said central opening to a lateral opening in the side of said nipple, said air release passage including a one-way valve therein providing for one way flow from said central opening in said nipple to said lateral opening in the nipple while preventing reverse flow thereof.

10. A nursing bottle according to claim 9 wherein said nipple includes a downwardly extending conduit on which said one way valve is integrally formed, said air release passage being detachably mounted on said conduit and to a lateral opening in the side of said nipple.

11. A nursing bottle according to claim 10 wherein said nipple is provided with a plurality of liquid intake holes disposed about the central opening in said nipple.

* * * * *